US007562482B1

(12) United States Patent
Johnson

(10) Patent No.: US 7,562,482 B1
(45) Date of Patent: Jul. 21, 2009

(54) SPARE MAGAZINE CARRIER WITH INDEPENDENT LATCH MECHANISM

(76) Inventor: David A. Johnson, P.O. Box 12517, Salem, OR (US) 97309

( * ) Notice: Subject to any disclaimer, the term of this patent is extended or adjusted under 35 U.S.C. 154(b) by 418 days.

(21) Appl. No.: 11/305,082

(22) Filed: Dec. 16, 2005

(51) Int. Cl.
*F41A 9/63* (2006.01)

(52) U.S. Cl. ..... 42/90; 42/50; 42/88

(58) Field of Classification Search ..... 42/87, 42/88, 6, 90, 106, 49.01, 50, 22
See application file for complete search history.

(56) References Cited

U.S. PATENT DOCUMENTS

| | | | | |
|---|---|---|---|---|
| 1,069,339 | A | 8/1913 | Layman | |
| 2,130,383 | A | 9/1938 | End | |
| 2,305,033 | A | 12/1942 | Roemer | |
| 2,396,184 | A | 3/1946 | Lima | |
| 2,931,120 | A * | 4/1960 | Kolin | 42/18 |
| 4,100,694 | A | 7/1978 | Musgrave | |
| 4,107,863 | A | 8/1978 | Musgrave | |
| 4,115,943 | A | 9/1978 | Musgrave | |
| 4,120,109 | A | 10/1978 | Musgrave | |
| 4,272,903 | A | 6/1981 | Griffis | |
| 4,387,525 | A | 6/1983 | Musgrave | |
| 4,429,479 | A | 2/1984 | Johnson | |
| 4,442,962 | A | 4/1984 | Musgrave | |
| 4,484,403 | A * | 11/1984 | Schwaller | 42/50 |
| 4,484,404 | A | 11/1984 | Johnson | |
| 4,597,213 | A | 7/1986 | Musgrave | |
| 4,628,627 | A | 12/1986 | Johnson | |
| 4,799,323 | A | 1/1989 | Musgrave | |
| 5,279,059 | A | 1/1994 | Howard | |
| 5,519,954 | A * | 5/1996 | Garrett | 42/6 |
| 5,636,465 | A * | 6/1997 | Johnson | 42/90 |
| 6,698,129 | B1 * | 3/2004 | Hanks | 42/90 |
| 6,722,253 | B2 * | 4/2004 | Johnson | 89/1.42 |
| 6,763,755 | B2 * | 7/2004 | Johnson | 89/1.42 |
| 6,829,855 | B2 * | 12/2004 | Seifert | 42/90 |
| 6,901,837 | B2 * | 6/2005 | Johnson | 89/1.4 |
| 2003/0200693 | A1 * | 10/2003 | Seifert | 42/71.01 |

* cited by examiner

*Primary Examiner*—Michael Carone
*Assistant Examiner*—Benjamin P Lee
(74) *Attorney, Agent, or Firm*—Chernoff, Vilhauer, McClung & Stenzel, LLP

(57) ABSTRACT

A protective carrier to hold a loaded spare magazine in a position of readiness for immediate insertion into operative engagement with a firearm. A latch release mechanism is operable wholly independent of the operation of the magazine release mechanism of the firearm, so that a spare magazine will remain in the protective carrier despite release of a magazine from the firearm. The spare magazine can be released from the carrier by pressing a latch release lever located for convenient use by either a left-handed or a right-handed rifleman.

19 Claims, 7 Drawing Sheets

SPARE MAGAZINE CARRIER WITH INDEPENDENT LATCH MECHANISM

BACKGROUND OF THE INVENTION

The present invention relates to repeating firearms, and particularly to an accessory for a repeating firearm using a replaceable magazine.

In land warfare the individual infantry solider is still an important part of military operations. The effectiveness of the individual soldier depends to a large extent on the accuracy, rate of fire, and number of rounds of ammunition that each individual soldier is capable of providing. For that reason, modern infantry firearms are capable of high cyclic rates of fire and are usually equipped with magazines capable of holding dozens of cartridges. Such magazines must usually be manually released from the firearm when they have become empty, at which time a full magazine must be inserted into the firearm before firing may be continued. In order to be capable of sustained firing, an infantry soldier carries loaded spare magazines, typically held in protective pouches attached to ammunition belts. When actually engaged in combat it is common for soldiers to carry spare magazines more immediately ready for use, since removal of a loaded magazine from a cartridge belt may take an undesirably long time.

It is clumsy, however, to carry a loaded spare magazine in one's hand, since it detracts from the ability to hold the firearm securely and aim it accurately.

Previous ways to approach these problems are disclosed in U.S. Pat. Nos. 4,484,404 and 5,636,465. In order to provide an ability to fire additional rounds quickly, spare magazine carriers disclosed in these patents allow a spare magazine to be carried alongside the receiver of a rifle, ready for immediate use.

However, with each of these devices, both the spare magazine and the active magazine are released from their respective locations simultaneously, although in certain circumstances, a rifleman would prefer to release the active magazine from the firearm without releasing the spare magazine from its spare magazine carrier.

In case of certain malfunctions of a rifle it is desirable to release an active magazine from the rifle, yet the spare magazine should be retained in a spare magazine carrier to prevent it from interfering with clearance of the malfunction. However, using the devices shown in the patents mentioned above, it would be difficult or awkward to release either magazine selectively rather than releasing both magazines simultaneously, because magazine latch mechanisms of the spare magazine carrier and the firearm are arranged to cooperate with on another. While one such known mechanism provides for separate release of a spare magazine, it makes separate release of an active magazine difficult or awkward.

The spare magazine carriers disclosed in the mentioned patents are not particularly well adapted for use by left-handed shooters without the risk of dropping the loaded spare magazine.

What is desired, then, is to provide a spare magazine carrier for use with a repeating firearm, in which a spare magazine is securely held, readily available and easily released to be inserted into the receiver of the firearm, by a user who is either right-handed or left-handed. At the same time, the spare magazine should not be released automatically from the carrier in response to release of an active magazine from operative engagement in the firearm, nor should release of the spare magazine be necessary for easy release of an active magazine from a firearm.

SUMMARY OF THE INVENTION

The present invention provides an answer to the aforementioned needs by providing a protective spare magazine carrier to hold a loaded spare magazine securely adjacent to the receiver of a firearm, yet readily available and releasable, as defined by the claims included herein.

As one aspect of the spare magazine carrier disclosed, an easily accessible latch mechanism is provided on the spare magazine carrier to act wholly independently from the magazine latch mechanism of the firearm.

In one embodiment of the spare magazine carrier, the latch mechanism includes a spring-biased plunger that is moveable by a release lever that is operated separately from the magazine latch mechanism of a firearm on which the spare magazine carrier may be mounted.

In one embodiment a latch release lever is carried on a shaft of such a plunger and is located conveniently for operation by a left-handed shooter using the left trigger finger, or by a right-handed shooter using the left thumb.

In one embodiment, the spare magazine carrier includes a downwardly open box-like body portion including a top and sides which protectively surround the open upper or outfeed end of the spare magazine. A catch included in the spare magazine carrier engages a spare magazine in the carrier in a manner similar to that by which a corresponding firearm engages a similar magazine.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
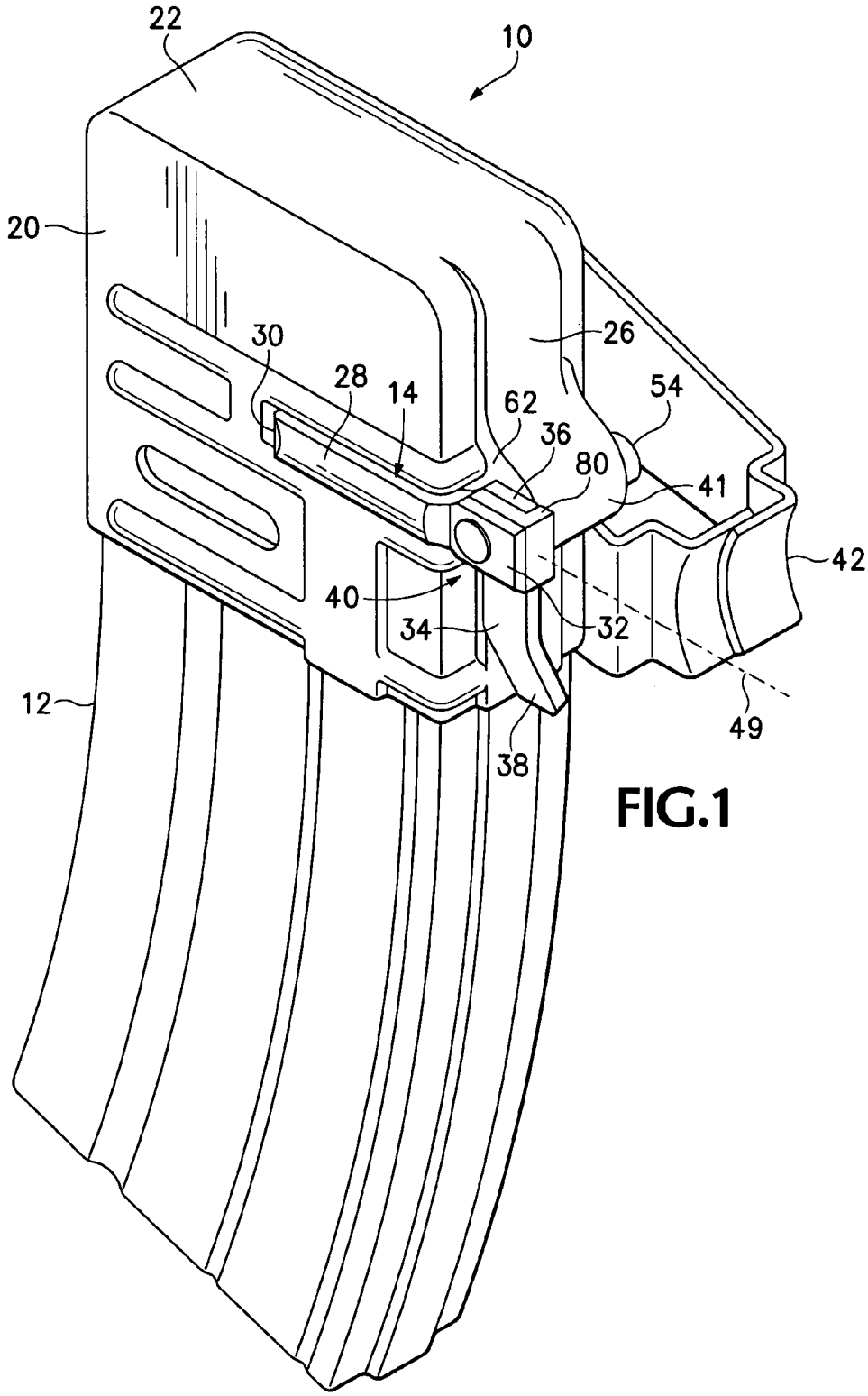
FIG. 1 is an isometric view of an exemplary spare magazine carrier embodying the present invention, taken from the left rear.

Referring now to the drawings which form a part of the disclosure herein, a spare magazine carrier 10 shown in FIG. 1 is capable of receiving a spare magazine 12 and holding it ready for easy access by a rifleman. The spare magazine carrier 10 includes a magazine latch mechanism 14 that holds a spare magazine 12 in the carrier 10 and can release the spare magazine when desired by the rifleman. The spare magazine carrier 10 has a body 20 with a closed upper end 22 that defines a downwardly open receptacle 24, capable of receiving an upper end of the spare magazine 12. The body 20 of the spare magazine carrier 10 may be made of sheet metal or another suitably strong and heat resistant material such as fiber reinforced plastic resins. The shape of the body 20 of the spare magazine carrier 10 is preferably chosen to provide ample clearance for access by the rifleman to operating mechanisms such as a bolt latch release lever located on the left side of the receiver of the firearm, as shown in FIG. 2.

The latch mechanism 14 is located on a rear side 26 of the body 20 of the spare magazine carrier 10, and includes a latch arm 28 having a front end 30 and a rear end 32, a release lever 34 having an attached end 36 and a free end 38, and a plunger assembly 40. A portion of the body 20 of the spare magazine carrier 10 is formed as a plunger housing 41 which functions to support and protect the plunger assembly 40. The plunger housing 41 may be provided as an ear-shaped extension of or an attachment located on the body 20 of the spare magazine carrier 10.

Figure 2:
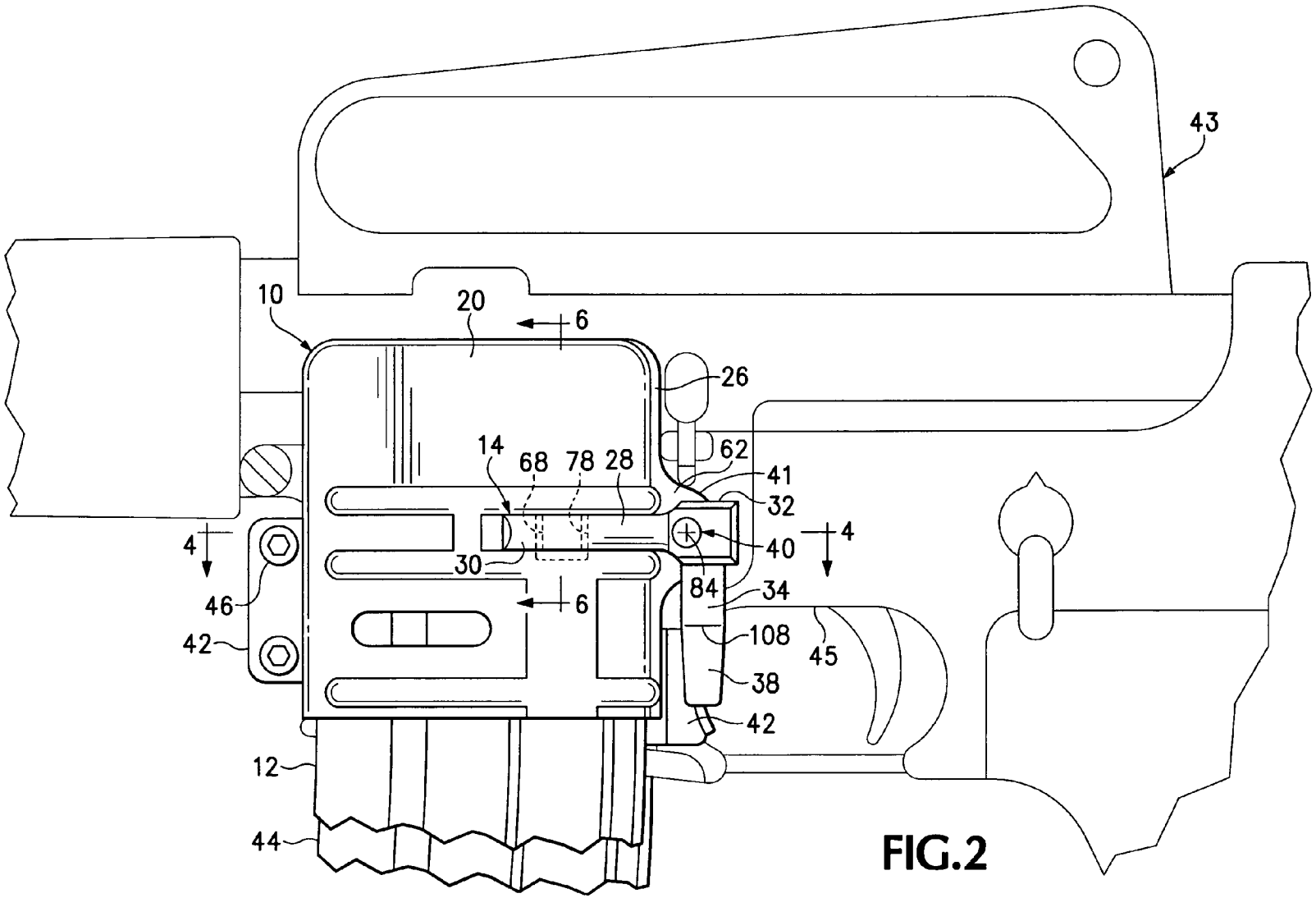
FIG. 2 is a left side elevational view of an automatic weapon to which the spare magazine carrier shown in FIG. 1 is attached.

A mounting device 42 is attached to the spare magazine carrier 10 for securing the spare magazine carrier 10 to a firearm 43, such as an automatic rifle, as shown in FIG. 2. The spare magazine 12 is thus supported in a position generally parallel with and alongside an active magazine 44 that is carried in the firearm 18, so as to have the spare magazine 12 ready to be inserted into the receiver 45 of the firearm 43 at the appropriate time. The spare magazine carrier 10 thus holds the spare magazine 12 so that it is in a convenient location for the rifleman to quickly insert the loaded spare magazine 12 into the firearm. The mounting device 42 may, for example, be a strap of material similar to that of the body 20, attached to the back side of the body 20 and arranged to wrap around the receiver 45 of the firearm 43 and to be held securely attached to the firearm 43 by an adjustable fastener such as a bolt and nut combination 46.

Figure 3:
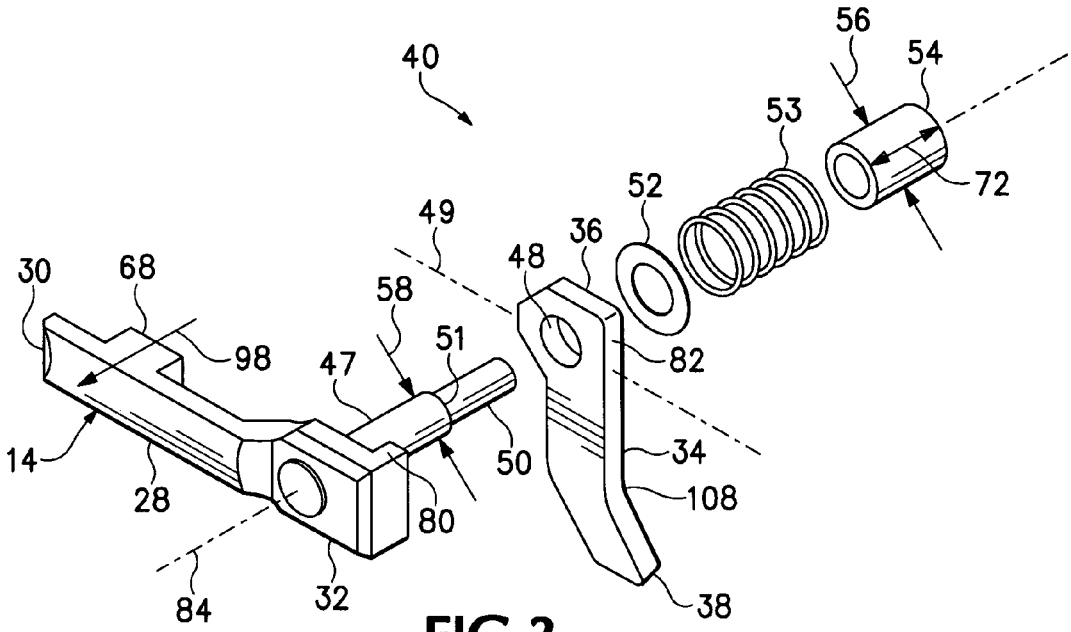
FIG. 3 is an exploded isometric view of a latch mechanism which is a part of the spare magazine carrier shown in FIG. 1.

Referring now to FIG. 3, the latch mechanism 14 including the plunger assembly 40 is shown in an exploded view, where it may be seen that the plunger assembly 40 includes a plunger shaft 47 whose outer or front end is fastened securely, as by being riveted, to the rear end 32 of the latch arm 28. A through-hole 48 defined in the attached end 36 of the release lever 34 is large enough to fit loosely over the plunger shaft 47, to allow the release lever 34 to rock about a rocking axis 49 extending transversely with respect to the plunger shaft 47. A rear, or inner end, portion 50 of the plunger shaft 47 is of a reduced diameter beyond a shoulder 51. The latch release lever 34, an anti-rattle spring 52, and a plunger spring 53 fit on the plunger shaft 47 and are held in place by a sleeve 54 which fits snugly on the inner end portion 50, as may be seen in FIGS. 4A, 4B, 5A, and 5B. The sleeve 54 has an outside diameter 56 enough greater than the diameter 58 of the main or central portion of the plunger shaft 47 to retain the plunger spring 53.

The plunger housing 41 defines a hole 60 in its outer, or front wall 62 that has a diameter slightly greater than the diameter 58 of the plunger shaft 47, so that the plunger shaft 47 can fit slidingly through the hole 60. A hole 64 defined in the rear or inner wall 66 of the plunger housing 41 is larger, having a diameter slightly larger than the outside diameter 56 of the sleeve 54, so that the sleeve 54 can fit slidingly through the hole 64.

The latch mechanism 14 is assembled as part of the spare magazine carrier 10 by placing the latch release lever 34 and the anti-rattle spring 52 on the plunger shaft 47 and then inserting the plunger shaft 47 through the hole 60 in the front wall 62. Next the plunger spring 53 is slid along the plunger shaft 47 through the hole 64 in the rear wall 66, and then the sleeve 54 is fitted onto the rear or inner end portion 50 of the plunger shaft 47 and urged into contact against the shoulder 51, slightly compressing the plunger spring 53, as the latch arm 28 is urged toward the inner or back side of the body 20 of the spare magazine carrier 10.

A catch 68 carried on the latch arm 28 is located so that it extends inwardly through an opening 70 in the left side of the body 20 when the latch arm 28 is properly oriented with respect to the body 20, as shown in FIG. 2.

Figure 5A:
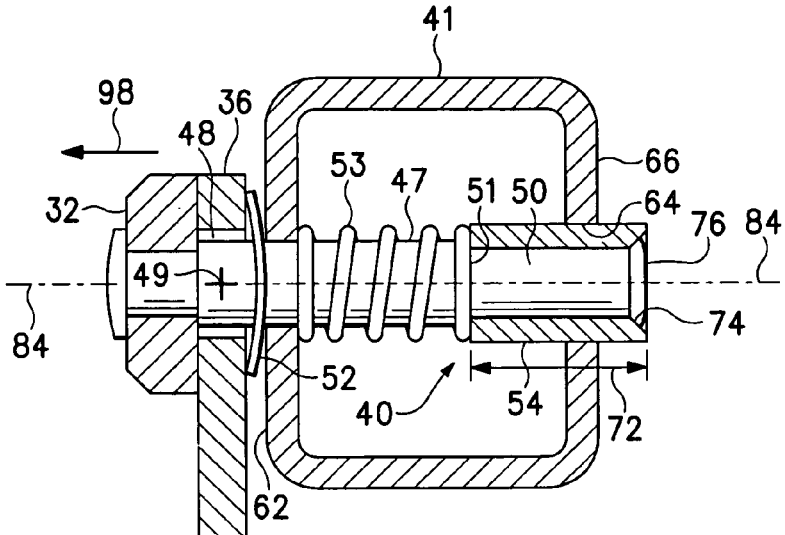
FIG. 5A is a sectional view of the spare magazine carrier, at an enlarged scale, taken along line 5A-5A in FIG. 4A, showing the latch mechanism engaging the spare magazine.

As shown in FIG. 5A, the sleeve 54 has a length 72 equal to the length of the reduced-diameter inner end portion 50 of the plunger shaft 47, and the bore of the sleeve 54 is chamfered at its rear, or inner, end 74. This chamfered end provides a ready point of purchase so that the inner end of the plunger shaft 47 can easily be made to engage the sleeve 54 by punching or peening the inner end face 76 of the shaft 47 to cause it to flare outward to engage the chamfered inner end 74 of the sleeve.

Figure 4A:
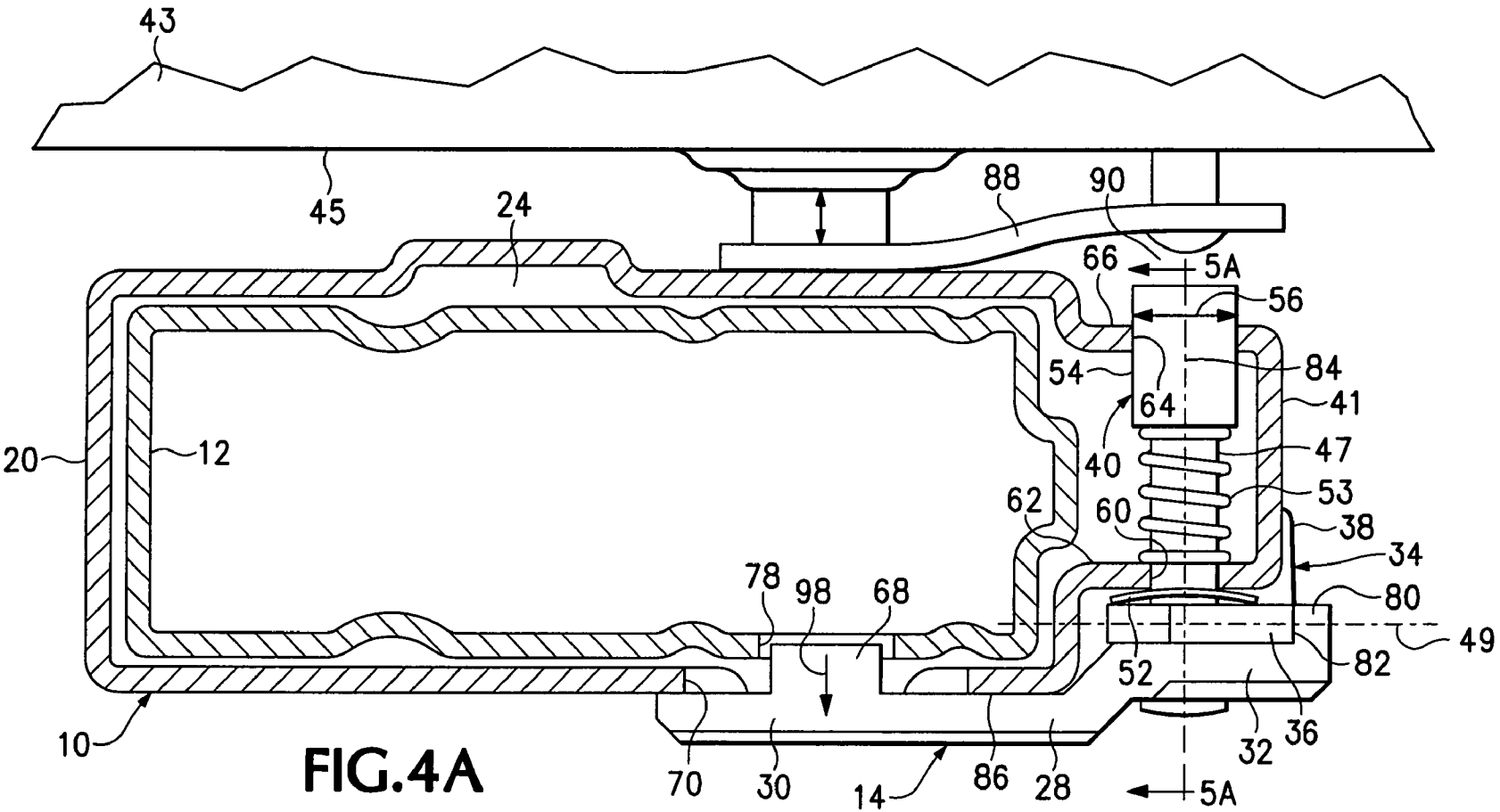
FIG. 4A is a sectional view taken along line 4-4 in FIG. 2, showing the spare magazine carrier and a magazine carried therein, together with a portion of the receiver of the automatic weapon.

As shown in FIGS. 4A and 5A, the plunger spring 53 is slightly compressed between the sleeve 54 and the front wall 62 of the plunger housing 41, so that the plunger spring 53 urges the plunger assembly 40 rearward, carrying the latch arm 28 toward the body 20 and thus carrying the catch 68 inwardly through the opening 70. The catch 68 thus extends inwardly through the opening 70 into the receptacle 24 defined by the body 20 and into a latch receptacle or socket 78 in the outer side of the spare magazine 12. The receptacle 78 is ordinarily engaged by the magazine latch mechanism of the firearm when the magazine is in use in the firearm 43.

When the latch mechanism 14 of the spare magazine carrier 10 is thus engaged with a spare magazine 12 as shown in FIGS. 2, 4A, and 5A, the latch release lever 34 is oriented vertically as seen from the side, as in FIG. 2. A flange 80 extends laterally inwardly from the rear end 32 of the latch carrying arm 20, and extends closely alongside a rear face 82 of the upper, or attached, end 36 of the latch release lever 34. The flange 80 thus prevents the latch release lever 34 from rotating about the longitudinal axis 84 of the plunger shaft 47, so that the latch release lever 34 remains in the position shown in FIG. 2, where it is ready for use.

The force of the slightly compressed plunger spring 53 operates to keep the catch 68 engaged in the latch receptacle 78 and also keeps the latch arm 28 snugly alongside the left or outer surface 86 of the body 20, as seen in FIG. 4A. Since the construction of the body 20 may result in some clearance between the latch carrier arm 28 and the front wall 62 of the plunger housing 41, the anti-rattle spring 52 urges the latch release lever 34 against the latch carrier arm 28 to prevent the latch release lever 34 from rattling against the plunger housing 41. While the anti-rattle spring is shown as a bowed flat spring washer, other forms of springs could be used instead.

Figure 4B:
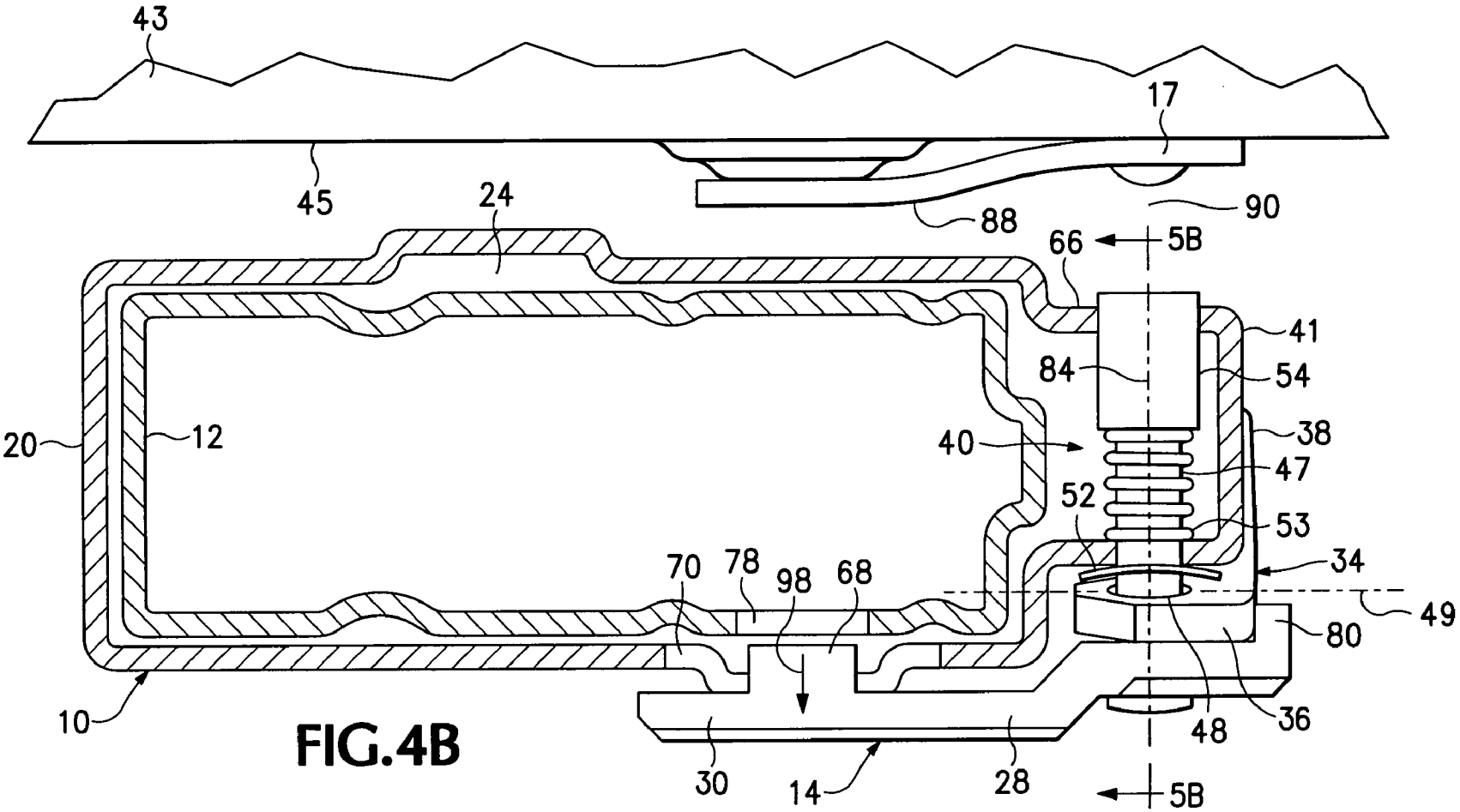
FIG. 4B is a view similar to FIG. 4A, with the latch mechanism disengaged and the spare magazine released from the spare magazine carrier.

As is shown best in FIGS. 4A and 4B, the mounting device 42 holds the body 20 of the spare magazine carrier 10 spaced far enough laterally away from the receiver 45 to provide ample clearance for lateral movement of mechanisms associated with the receiver, such as a magazine latch mechanism 88 of the firearm 43. The location of the body 20 of the spare magazine carrier 10 also provides ample space between the inner end 76 of the plunger shaft 47 and a magazine latch mechanism 88, as shown in FIG. 4A at 90, so that when the magazine latch mechanism 88 is moved out leftward from the receiver 45 to release a magazine from the rifle 43 it does not encounter and is thus unable to move the plunger assembly 40 in a direction tending to disengage the catch 68 from the latch receptacle 78 in the spare magazine 12. Thus the rifleman can utilize the magazine latch mechanism 88 of the firearm 43 regardless of the presence of a spare magazine 12 in the spare magazine carrier 10, to release a magazine 44 or retain it in its usual status of engagement where it can perform its normal function of providing cartridges to the firing chamber of the firearm 43, with no effect on the retention of the spare magazine 12 in the spare magazine carrier 10 as shown in FIG. 2.

Figure 6A:
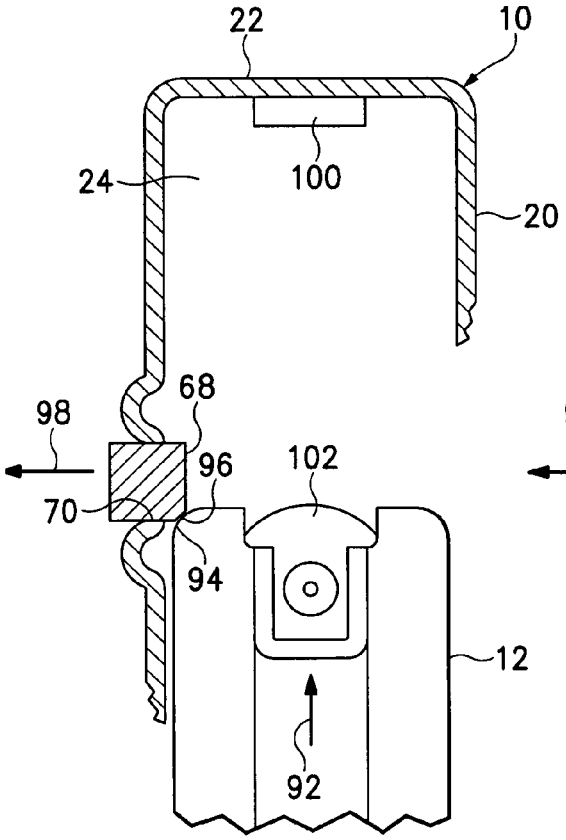
FIG. 6A is a sectional view of a portion of the spare magazine carrier, at an enlarged scale, taken along line 6-6 of FIG. 2, and showing a spare magazine being placed into the carrier.
Figure 6B:
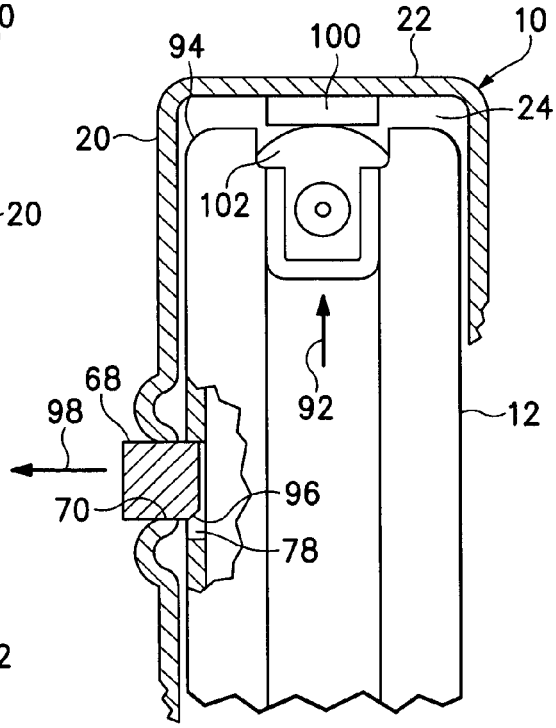
FIG. 6B is a view similar to FIG. 6A, but showing the spare magazine latched into the spare magazine carrier.

Referring to FIGS. 6A and 6B, when a spare magazine 12 is inserted into the receptacle 24 of the spare magazine carrier 10 of the type shown in FIGS. 1 and 2, the upper end of the spare magazine is inserted into the open bottom of the receptacle 24 in an upward direction as indicated by the arrow 92, and a shoulder 94 of the spare magazine encounters the catch 68, whose lower edge 96 is preferably chamfered to enable the catch 68 to follow the shape of the shoulder 94 of the upper end of the spare magazine 12 easily. Moving the spare magazine 12 further upward, in the direction of the arrow 92, forces the catch 68 laterally outward, in the direction of the arrow 98 in FIG. 6A. This also carries the entire latch arm 28 laterally in the direction of the arrow 98, and thus moves the plunger assembly 40 in the same direction, further compressing the plunger spring 53. The plunger assembly 40 is thus moved to a position such as that shown in FIGS. 4B and 5B as the spare magazine 12 is moved the remaining distance into full engagement in the receptacle 24 of the spare magazine carrier 10. Once the upper margin of the latch receptacle 78 in the spare magazine 12 reaches the upper face of the catch 68 the catch 68 is free to move laterally inward under the influence of the plunger spring 53, in the direction opposite the arrow 98, into engagement in the receptacle 78, to the position shown in FIGS. 6B and 4A.

Ordinarily, a multi-round magazine such as the spare magazine 12 includes a spring-biased follower (not shown) that urges cartridges in the magazine upward toward the outfeed end of the magazine. The receptacle 24 may therefore include a downwardly protruding strip 100 aligned to encounter a cartridge 102 carried in the spare magazine 12, in order to use the force of the follower spring to urge the spare magazine 12 downward to keep the latch receptacle 78 firmly engaged against the upper face of the catch 68 and thus minimize rattling of a spare magazine 12 held in the spare magazine carrier 10.

Figure 5B:
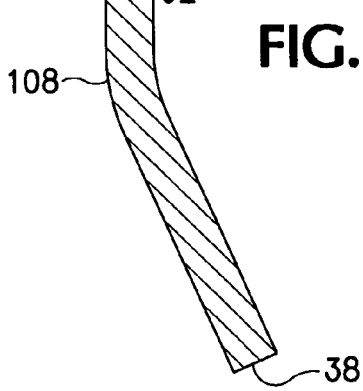
FIG. 5B is a sectional view of the spare magazine carrier, at an enlarged scale, taken along line 5B-5B in FIG. 4B, showing the latch release lever moved to disengage the latch mechanism from the spare magazine.
Figure 5B:
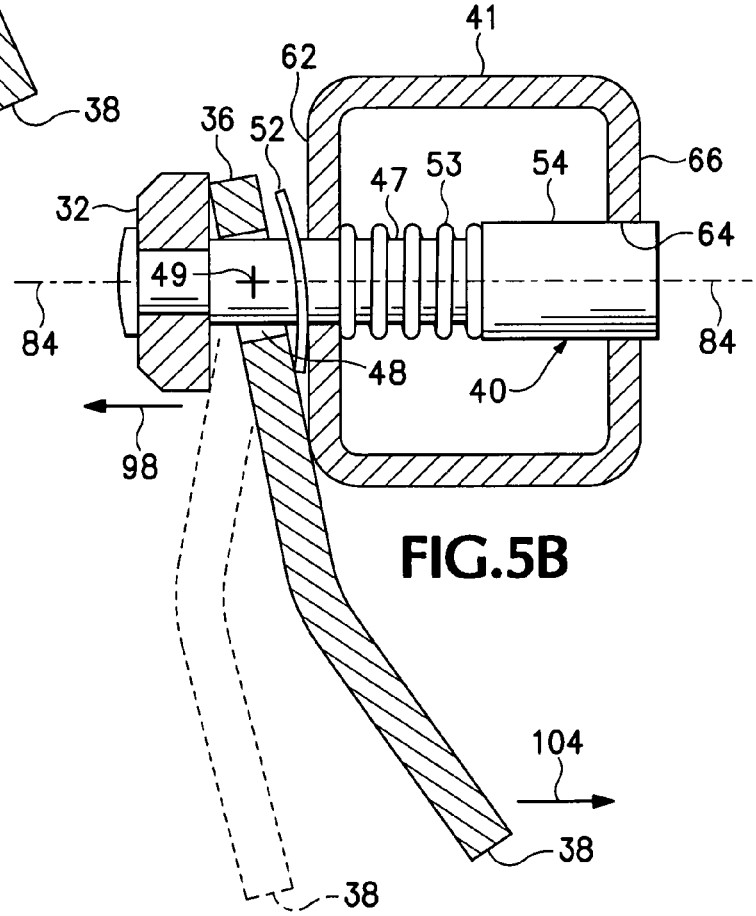

Referring now to FIGS. 4B and 5B, when the rifleman desires to release a spare magazine 12 from the spare magazine carrier 10 the latch arm 28 has to be moved laterally in the direction of the arrow 98. This is ordinarily accomplished by pushing the latch release lever 38 laterally inward toward the receiver 45, in the direction of the arrow 104 in FIG. 5B. The hole 48 is large enough to receive the plunger shaft 47 loosely enough to permit the latch release lever 34 to rock about the rocking axis 49, which extends transversally and perpendicular to the longitudinal axis 84 of the plunger shaft 47, from the position shown in FIG. 5A to the position shown in FIG. 5B. In the position shown in FIG. 5B the upper, attached, end 36 presses against the adjacent inner surface of the rear end 32 of the latch arm 28, while a lower portion of the latch release arm 34 presses inwardly against the front wall 62 of the plunger housing 41, pivoting about the lower corner of the plunger housing 41. As a result the upper, attached end 36 pushes the latch arm 28 laterally outward, in the direction of the arrow 98, while the plunger assembly 14 is kept aligned properly by its sliding fit in the holes 60 and 64. As shown in FIG. 4B, this moves the catch 68 laterally out of engagement in the latch receptacle 78, freeing the spare magazine 12 to move downward and out of the receptacle 24. To the extent that the follower spring in the spare magazine is compressed by contact between a cartridge 102 and strip 100 within the receptacle 24, the spare magazine 12 will be urged from the receptacle 24 by the force of the follower spring of the spare magazine 12 as well as by gravity.

Figure 7:
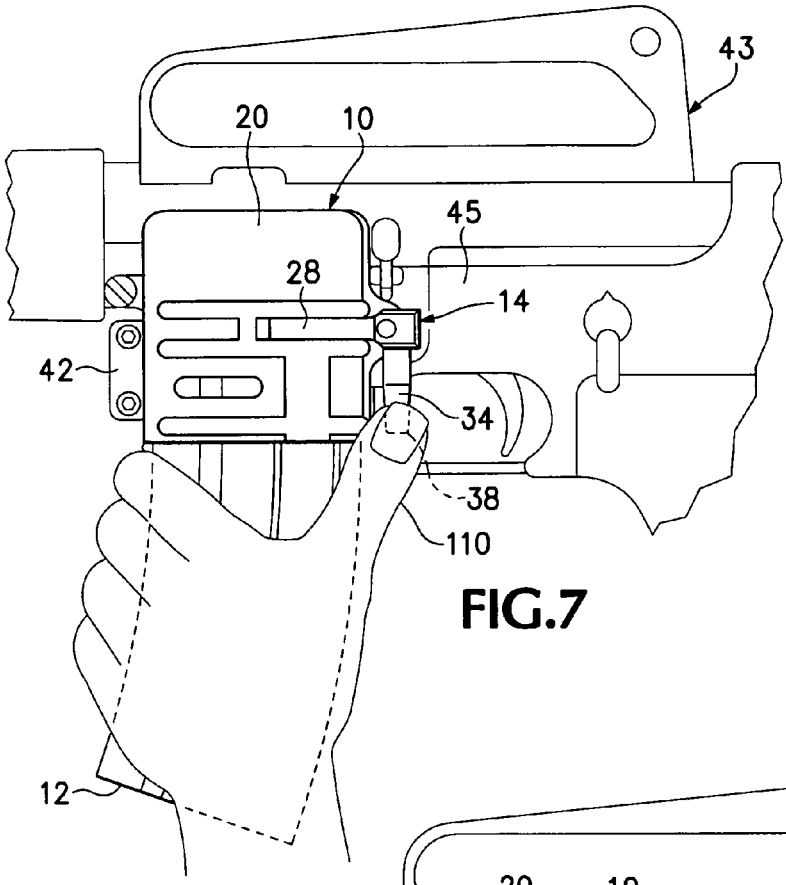
FIG. 7 is a view similar to FIG. 2, at a reduced scale, and also showing a right-handed user's left hand engaging the latch release lever of the spare magazine carrier.
Figure 8:
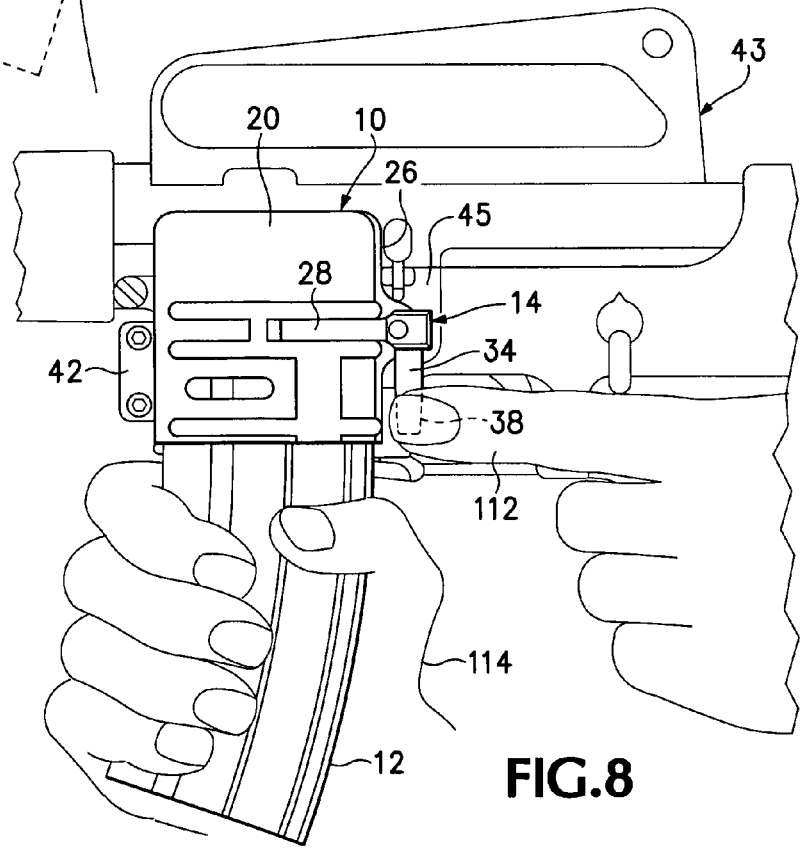
FIG. 8 is a view similar to FIG. 2, at a reduced scale, and also showing a left-handed user's left hand engaging the latch release lever of the spare magazine carrier.

It will be understood that the plunger assembly 40 could also be moved to disengage the latch assembly 14 by pulling outward on the lower, or free, end 38 of the latch release lever 34 toward the position shown in broken line in FIG. 5B, but that is not the normally intended method of releasing the spare magazine 12 from the spare magazine carrier 10. The latch release lever 34 is preferably shaped to include a bend as at 108 so that the lower, or free, end 38 extends downward at a diagonally inward slant toward the receiver 45 of the rifle 43. This shape of the latch release lever 34 places the lower, free end 38 in a location where it conveniently available to be pressed by the rifleman as illustrated in FIGS. 7 and 8. This shape of the latch release lever 34 also places the free end 38 in a position where it is less likely to be snagged easily on one's clothing or on vegetation or other articles in the environment through which a rifleman is caring a firearm equipped with the spare magazine carrier 10. Additionally, the release lever 34 and the latch arm 28 are preferably shaped, beveled, and smoothed so as not to catch on clothing or other materials.

Referring now to FIGS. 7 and 8, a rifleman normally operates the latch release mechanism 14 by pushing the free end 38 of the release lever 34 toward the firearm 18. In FIG. 7, a right-handed user pushes the free end 38 of the release lever 34 by holding the spare magazine 12 with his left hand and pushing the free end 38 of the release lever 34 laterally inward toward the rifle 43 with his left thumb 110.

A left-handed user can conveniently operate the latch release mechanism 14 by pushing free end 38 of the release lever 34 with his left forefinger 112, as shown in FIG. 8, while he uses his right hand 114 to grasp the spare magazine 12.

The terms and expressions which have been employed in the foregoing specification are used therein as terms of description and not of limitation, and there is no intention, in the use of such terms and expression, of excluding equivalents of the features shown and described or portions there, it being recognized that the scope of the invention is defined and limited only by the claims which follow.

I claim:

1. A spare magazine carrier, comprising:

(a) a body defining a receptacle open to receive a spare magazine;

(b) a latch mechanism associated with said body, arranged to engage said spare magazine and elastically biased to retain said spare magazine engaged with said body;

(c) a mounting device capable of attaching said body to a lateral side of a receiver of a firearm laterally alongside an active magazine carried in the firearm; and (d) a latch release mechanism associated with said latch mechanism, said latch release mechanism being operable only wholly independently from operation of any magazine retention mechanism of said firearm while said body is attached to said lateral side of said receiver, said latch release mechanism including a latch release lever, said latch release lever being elastically biased to remain in a first position wherein said latch mechanism engages said spare magazine, and said latch release lever being mounted so as to be able to rock with respect to said body to both a second position and a third position, said second and third positions being found in opposite directions from said first position, said latch release lever causing said latch mechanism to disengage said spare magazine so as to release said spare magazine from said body when said latch release lever is rocked to either of said second and third positions.

2. The spare magazine carrier of claim 1 wherein said latch mechanism includes a plunger assembly and a catch arranged to be moved by said plunger assembly, and wherein said latch release lever is arranged to move said plunger assembly with respect to said body to move said catch in a magazine releasing direction.

3. The spare magazine carrier of claim 2 wherein said latch release lever has an attached end and a free end, said attached end defining a through-hole, and said plunger assembly including a plunger shaft extending through said through-hole, said through-hole being large enough to allow said latch release lever to rock with respect to said plunger shaft about a rocking axis oriented transverse to a longitudinal axis of said plunger shaft to either of said second and third positions.

4. The spare magazine carrier of claim 3 wherein said body includes a plunger housing and a portion of said latch release lever bears against an outer surface of said plunger housing when a free end of said latch release lever is rocked to one of said second and third positions.

5. A spare magazine carrier, comprising:

(a) a body including a plunger housing and defining a receptacle open to receive a spare magazine;

(b) a latch mechanism associated with said body, arranged to engage said spare magazine and elastically biased to retain said spare magazine engaged with said body, said latch mechanism including a plunger assembly and a catch arranged to be moved by said plunger assembly;

(c) a mounting device capable of attaching said body to a firearm laterally alongside an active magazine carried in the firearm;

(d) a latch release mechanism associated with said latch mechanism, said latch release mechanism being operable wholly independently from any magazine retention mechanism of said firearm and including a latch release lever arranged to move said plunger assembly with respect to said body to move said catch in a magazine releasing direction, said latch release lever having an attached end and a free end, said attached end defining a through-hole, and said plunger assembly including a plunger shaft extending through said through-hole, said through-hole being large enough to allow said latch release lever to rock through a predetermined angle with respect to said plunger shaft about a rocking axis oriented transverse to a longitudinal axis of said plunger shaft, and a portion of said latch release lever bearing against an outer surface of said plunger housing when a free end of said latch release lever is moved laterally inward through said predetermined angle; and including (e) a latch arm having an end, said end being mounted on said plunger shaft, and wherein said attached end of said latch release lever contacts said end of said latch arm and thereby moves said latch arm and said plunger shaft when said latch release lever is rocked about said rocking axis.

6. The spare magazine carrier of claim 5 wherein said latch release lever is located on said plunger shaft between said plunger housing and said latch arm, so that urging said free end inwardly with respect to said plunger housing results in said latch arm being urged outwardly into a latch releasing position.

7. The spare magazine carrier of claim 5 wherein said latch arm has a flange that extends along a surface of said latch release lever, said flange preventing said latch release lever from rotating about said longitudinal axis of said plunger shaft.

8. The spare magazine carrier of claim 5 wherein an anti-rattle spring is mounted on said plunger shaft adjacent said attached end of said latch release lever.

9. The spare magazine carrier of claim 5 wherein a first portion of said free end of said latch release lever extends perpendicular to said longitudinal axis and a second portion of said free end extends obliquely inwardly from said first portion.

10. In combination with a firearm, a spare magazine carrier, comprising:

(a) a body defining a receptacle open to receive a spare magazine, said body being attached to a lateral side of a receiver of said firearm laterally alongside an active magazine carried in the firearm;

(b) a latch mechanism associated with said body, arranged to engage said spare magazine and elastically biased to retain said spare magazine engaged with said body; and (c) a latch release mechanism associated with said latch mechanism, said latch release mechanism being operable only wholly independently from operation of any magazine retention mechanism of said firearm, said latch release mechanism including a latch release lever, said latch release lever being elastically biased to remain in a first position wherein said latch mechanism engages said spare magazine, and said latch release lever being mounted so as to be able to rock with respect to said body to both a second position and a third position, said second and third positions being found in opposite directions from said first position, said latch release lever causing said latch mechanism to disengage said spare magazine so as to release said spare magazine from said body when said latch release lever is rocked to either of said second and third positions.

11. The combination of claim 10 wherein said latch mechanism includes a plunger assembly and a catch arranged to be moved by said plunger assembly, and wherein said latch release lever is arranged to move said plunger assembly with respect to said body to move said catch in a magazine releasing direction.

12. The combination of claim 11 wherein said latch release lever has an attached end and a free end, said attached end defining a through-hole, and said plunger assembly including a plunger shaft extending through said through-hole, said through-hole being large enough to allow said latch release lever to rock with respect to said plunger shaft about a rocking axis oriented transverse to a longitudinal axis of said plunger shaft to either of said second and third positions.

13. The combination of claim 12 wherein said body includes a plunger housing and a portion of said latch release lever bears against an outer surface of said plunger housing when a free end of said latch release lever is rocked to one of said second and third positions.

14. In combination with a firearm, a spare magazine carrier, comprising:

(a) a body defining a receptacle open to receive a spare magazine, said body being attached to said firearm laterally alongside an active magazine carried in the firearm;

(b) a latch mechanism associated with said body, arranged to engage said spare magazine and elastically biased to retain said spare magazine engaged with said body, said latch mechanism including a plunger assembly and a catch arranged to be moved by said plunger assembly;

(c) a latch release mechanism associated with said latch mechanism, said latch release mechanism being operable wholly independently from any magazine retention mechanism of said firearm, and said latch release mechanism including a latch release lever arranged to move said plunger assembly with respect to said body to move said catch in a magazine releasing direction, and said latch release lever having an attached end and a free end, said attached end defining a through-hole, and said plunger assembly including a plunger shaft extending through said through-hole, said through-hole being large enough to allow said latch release lever to rock through a predetermined angle with respect to said plunger shaft about a rocking axis oriented transverse to a longitudinal axis of said plunger shaft, and said body including a plunger housing and a portion of said latch release lever bearing against an outer surface of said plunger housing when a free end of said latch release lever is moved laterally inward through said predetermined angle; and (d) a latch arm having an end mounted on said plunger shaft, and wherein said attached end of said latch release lever contacts said end of said latch arm and thereby moves said latch arm and said plunger shaft when said latch release lever is rocked about said rocking axis.

15. The combination of claim 14 wherein said latch release lever is located on said plunger shaft between said plunger housing and said latch arm, so that urging said free end inwardly with respect to said plunger housing results in said latch arm being urged outwardly into a latch releasing position.

16. The combination of claim 14 wherein said latch arm has a flange that extends along a surface of said latch release lever, said flange preventing said latch release lever from rotating about said longitudinal axis of said plunger shaft.

17. The combination of claim 14 wherein an anti-rattle spring is mounted on said plunger shaft adjacent said attached end of said latch release lever.

18. The combination of claim 14 wherein a first portion of said free end of said latch release lever extends perpendicular to said longitudinal axis and a second portion of said free end extends obliquely inwardly from said first portion.

19. A spare magazine carrier, comprising:

(a) a body defining a receptacle open to receive a spare magazine;

(b) a latch mechanism associated with said body, arranged to engage said spare magazine and elastically biased to retain said spare magazine engaged with said body;

(c) a mounting device capable of attaching said body to a lateral side of a receiver of a firearm laterally alongside an active magazine carried in the firearm; and (d) a latch release mechanism associated with said latch mechanism, said latch release mechanism being operable only wholly independently from operation of any magazine retention mechanism of said firearm while said body is attached to said lateral side of said firearm, said latch release mechanism including a latch release lever having an end, said latch release lever being elastically biased so that said end remains in a first position when said latch mechanism engages said spare magazine, and said end being movable in a first direction from said first position to a second position and in an opposite second direction from said first position to a third position, said latch release lever causing said latch mechanism to disengage said spare magazine so as to release said spare magazine from said body when said end is in either of said second or third positions.

* * * * *